US010121628B2

(12) United States Patent
Koga et al.

(10) Patent No.: US 10,121,628 B2
(45) Date of Patent: Nov. 6, 2018

(54) EMITTER AND X-RAY TUBE DEVICE

(71) Applicant: SHIMADZU CORPORATION, Kyoto-shi, Kyoto (JP)

(72) Inventors: Yusuke Koga, Kyoto (JP); Sadamu Tomita, Nara (JP); Takumi Kobayashi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 167 days.

(21) Appl. No.: 15/365,052

(22) Filed: Nov. 30, 2016

(65) Prior Publication Data

US 2017/0169983 A1 Jun. 15, 2017

(30) Foreign Application Priority Data

Dec. 14, 2015 (JP) ..... 2015-242852

(51) Int. Cl.
*H01J 35/06* (2006.01)
*H01J 35/08* (2006.01)
*H05G 1/02* (2006.01)

(52) U.S. Cl.
CPC ..... *H01J 35/06* (2013.01); *H01J 35/08* (2013.01); *H05G 1/02* (2013.01)

(58) Field of Classification Search
CPC ..... H01J 35/02; H01J 35/025; H01J 35/04; H01J 35/045; H01J 35/06; H01J 2235/02; H01J 2235/023; H01J 2235/06
See application file for complete search history.

(56) References Cited

U.S. PATENT DOCUMENTS 4,698,835 A * 10/1987 Ono ..... H01J 35/06 313/453
6,259,193 B1 * 7/2001 Lipkin ..... H01J 1/18 313/271
6,464,551 B1 * 10/2002 Lipkin ..... H01J 1/18 445/50
2017/0169983 A1 * 6/2017 Koga ..... H01J 35/06
2017/0271116 A1 * 9/2017 Virshup ..... H01J 35/06

FOREIGN PATENT DOCUMENTS

WO 2014/041639 A1 3/2014

* cited by examiner

*Primary Examiner* — Thomas R Artman
(74) *Attorney, Agent, or Firm* — McDermott Will & Emery LLP

(57) ABSTRACT

An emitter for an X-ray tube device is configured to irradiate an anode with electrons for X-ray emission. The emitter includes an electron emission portion to be heated by an electric current, a current application leg for supplying the electric current to the electron emission portion, a support leg, a current application leg fixing portion for supporting the current application leg and supplying the electric current to the current application leg, and a support leg fixing portion for supporting the support leg. At least one of materials and shapes are different between the current application leg fixing portion and the support leg fixing portion so that a difference in an amount of thermal deformation between the current application leg and the support leg in a direction vertical to the electron emission portion is reduced when the electron emission portion is heated.

7 Claims, 8 Drawing Sheets

FIG. 7

| | FIRST EMBODIMENT | SECOND EMBODIMENT | COMPARATIVE EXAMPLE |
|---|---|---|---|
| CURRENT APPLICATION LEG FIXING PORTION | | | |
| MATERIAL | Mo | Mo | Mo |
| DIAMETER | 1.24mm | 1.50mm | 1.24mm |
| DISPLACEMENT AMOUNT (S1) | 92μm | 86μm | 88μm |
| SUPPORT LEG FIXING PORTION | | | |
| MATERIAL | Ni | Mo | Mo |
| DIAMETER | 1.24mm | 1.00mm | 1.24mm |
| DISPLACEMENT AMOUNT (S2) | 100μm | 69μm | 69μm |
| DIFFERENCE IN DISPLACEMENT AMOUNT | 8μm | 17μm | 19μm |

EMITTER AND X-RAY TUBE DEVICE

CROSS-REFERENCE TO RELATED APPLICATION

This application claims the benefit of Japanese Application No. 2015-242852, filed on Dec. 14, 2015, the entire contents of which is hereby incorporated by reference.

TECHNICAL FIELD

The present disclosure relates to an X-ray tube device and an emitter used therein.

RELATED ART

Conventionally, there has been known an emitter which emits electrons when the emitter is heated by an electrical current (see, for example, WO 2014/041639 A1).

WO 2014/041639 A1 discloses an emitter including a plate-shaped electron emission portion which emits electrons when the emitter is heated by the electrical current, a pair of plate-shaped current application legs configured to apply the electric current to the electron emission portion, and a pair of plate-shaped support legs which does not contribute to the application of the electric current to the electron emission portion. The current application legs and the support legs are respectively connected to fixing portions through which the emitter is installed in an X-ray tube device.

When the emitter is in operation (i.e., the emitter is heated by the electric current), the electron emission portion is heated to have high temperature. This may cause a sagging phenomenon to occur where gravity causes creep deformation, or cause external force to deform an electron emission surface of the electron emission portion. These deformations cause deterioration of electron emission characteristics and life shortening of the emitter. WO 2014/041639 A1 provides the support legs in addition to the current application legs to suppress deformation of the emission surface of the electron emission portion caused by the sagging phenomenon and external force.

SUMMARY

Since the support leg does not contribute to application of the electric current to the emitter to heat it (i.e., such that no electrical current application is performed by the support leg), a temperature difference occurs between the current application leg and the support leg when the electric current is applied to heat the emitter. It is desirable to not only suppress deformation of the emission surface caused by the sagging phenomenon and external force but also suppress deformation of the emission surface of the electron emission portion caused by a difference in the amount of thermal deformation between the current application leg and the support leg.

In order to solve the above problems, an object of this disclosure is to provide an emitter and an X-ray tube device which can suppress deformation of the emission surface of the electron emission portion caused by a difference in the amount of thermal deformation between the current application leg and the support leg when the emitter is heated with the electric current.

To achieve the above object, an emitter in one aspect of the present disclosure for an X-ray tube device is configured to irradiate an anode with electrons for emitting an X-ray from the anode, and includes an electron emission portion to be heated by an electric current, a current application leg for supplying the electric current to the electron emission portion, the current application leg extending from the electron emission portion in a direction vertical to the electron emission portion, a support leg extending from the electron emission portion in the direction vertical to the electron emission portion, a current application leg fixing portion for supporting the current application leg and supplying the electric current to the current application leg, and a support leg fixing portion for supporting the support leg. At least one of materials and shapes are different between the current application leg fixing portion and the support leg fixing portion. A difference in an amount of thermal deformation between the current application leg and the support leg in the direction vertical to the electron emission portion may be reduced when the electron emission portion is heated by the electric current.

At least one of materials and shapes may be different from the current application leg fixing portion and the support leg fixing portion. With such a difference, a difference in the amount of thermal deformation between the current application leg and the support leg in the direction vertical to the electron emission portion may be reduced. Accordingly, at least one of the amount of the thermal deformation and the amount of the heat transfer between the current application leg fixing portion and the support leg fixing portion can be different from each other. Consequently, the difference in the amount of thermal deformation between the current application leg and the support leg may be reduced when there is a difference in the amount of thermal deformation between the current application leg fixing portion and the support leg fixing portion, or when a temperature difference between the current application leg and the support leg is reduced based on a difference in the amount of heat transfer between the current application leg fixing portion and the support leg fixing portion. It may thus be possible to suppress deformation of the emission surface of the electron emission portion caused by the difference in the amount of thermal deformation between the current application leg and the support leg when the emitter is heated by the electric current.

The support leg fixing portion may be formed of a material having a coefficient of thermal expansion greater than that of the current application leg fixing portion. A temperature of the current application leg becomes higher than a temperature of the support leg when the electric current is supplied to the electron emission portion. When the coefficient of thermal expansion of the support leg fixing portion is relatively high, the difference in the amount of thermal deformation between the current application leg and the support leg can be reduced.

The current application leg fixing portion may be formed of a material having a first coefficient of thermal expansion, and the support leg fixing portion may also be formed of a material having a second coefficient of thermal expansion. The first coefficient of thermal expansion and the second coefficient of thermal expansion may be different from each other so that when the electron emission portion is heated by the electric current, a total amount of the thermal deformation of the current application leg and the current application leg fixing portion and a total amount of the thermal deformation of the support leg and the support leg fixing portion become closer to each other. Accordingly, the first coefficient of the thermal expansion and the second coefficient of the thermal expansion can be set such that the amount of the entire thermal deformation of the current application leg and the current application leg fixing portion and the amount of the entire thermal deformation of the support leg and the support leg fixing portion become closer to each other. Consequently, there may be no cases in which the thermal deformation amount of the support leg fixing portion is too large, or the thermal deformation amount of the current application leg fixing portion is too small, and the difference in the amount of thermal deformation between the current application leg and the support leg can be reliably and effectively reduced.

The current application leg fixing portion and the support leg fixing portion may have shapes having different cross-sectional areas in a direction parallel to the electron emission portion so that a temperature difference between the current application leg and the support leg can be reduced when the emitter is applied with the electric current. Accordingly, when the heat transfer areas of the current application leg fixing portion and the support leg fixing portion differ from each other, the temperature difference between the current application leg and the support leg can be reduced. The difference in the amount of thermal deformation between the current application leg and the support leg can thus be reduced.

The support leg fixing portion may include a portion of which the cross-sectional area in the direction parallel to the electron emission portion is smaller than the cross-sectional area of the current application leg fixing portion in the direction parallel to the electron emission portion. The temperature of the current application leg becomes higher than the temperature of the support leg when the electrical current is applied to the emitter. When the heat transfer area of the support leg fixing portion is made smaller than the heat transfer area of the current application leg fixing portion, the temperature difference between the current application leg and the support leg can be reliably reduced. Consequently, the difference in the amount of thermal deformation between the current application leg and the support leg can be reliably reduced.

The current application leg fixing portion and the support leg fixing portion may each have a columnar shape extending in the direction vertical to the electron emission portion and are connected respectively to the current application leg and the support leg. Accordingly, since the thermal deformation amount in the direction vertical to the electron emission portion can be easily calculated, it may be possible to easily obtain materials and shapes (outside dimensions) of the current application leg fixing portion and the support leg fixing portion for reducing the difference in the amount of thermal deformation between the current application leg and the support leg.

An X-ray tube device according to another aspect of this disclosure includes any emitter described above and an anode for emitting an X-ray by the electrons from the emitter.

According to the present disclosure, it may be possible to suppress deformation of the emission surface of the electron emission portion caused by the difference in the amount of thermal deformation between the current application leg and the support leg when the electron emission portion is heated by the electric current.

Additional aspects and advantages of the present disclosure will become readily apparent to those skilled in the art from the following detailed description, wherein only exemplary embodiments of the present disclosure is shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Examples of the subject matter claimed herein are illustrated in the figures of the accompanying drawings and in which reference numerals refer to similar elements and in which:

FIG. 7 is a table containing simulation results obtained by comparing displacement amounts in heating an emitter by an electric current, according to the first and second embodiments and a comparative example.

DESCRIPTION

Hereinafter, embodiments of the present disclosure will be described with reference to the drawings.

First Embodiment (Configuration of X-Ray Tube Device)

An X-ray tube device 100 according to a first embodiment will be described with reference to FIG. 1.

Figure 1:
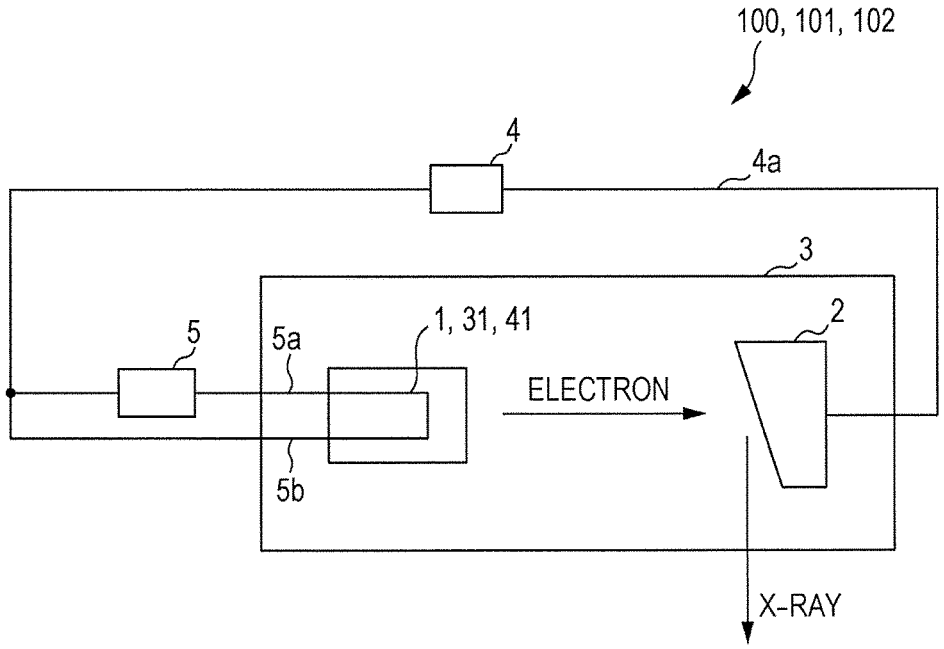
FIG. 1 is a block diagram exemplarily showing an X-ray tube device according to first to third embodiments of the present disclosure.

As shown in FIG. 1, the X-ray tube device 100 is configured to generate an X-ray. The X-ray tube device 100 includes an emitter 1 for generating an electron beam, an anode 2, a container (enclosure) 3 housing the emitter 1 and the anode 2, and power supply circuits 4 and 5.

The emitter 1 is configured to emit electrons (electron beam) toward the anode 2. The emitter 1 is disposed to face the anode 2. A predetermined voltage is applied between the emitter 1 and the anode 2 by the power supply circuit 4. Specifically, the emitter 1 and the anode 2 are connected to the power supply circuit 4 via a wiring 4*a*, and the anode 2 is configured to be applied with a relatively positive voltage, relative to the emitter 1. The emitter 1 is connected to the power supply circuit 5 via wirings 5*a* and 5*b*. The emitter 1 is heated by an electric current from the power supply circuit 5. Consequently, an electron beam (thermoelectron) is generated to travel from the emitter 1 toward the anode 2.

The anode 2 is formed of a metal. For example, the anode 2 is formed of a metal material such as copper, molybdenum, cobalt, chrome, iron, or silver. When the electron beam (thermoelectron) emitted from the emitter 1 impinges on the anode 2, the anode 2 generates an X-ray.

The emitter 1 and the anode 2 are arranged in the container 3. The inside of the container 3 is sealed in a substantially vacuum state. The container 3 is formed of, for example, a nonmagnetic metal material such as stainless steel (SUS). The container 3 has a window (not shown) through which an X-ray is emitted outside.

(Configuration of Emitter)

Figure 2:
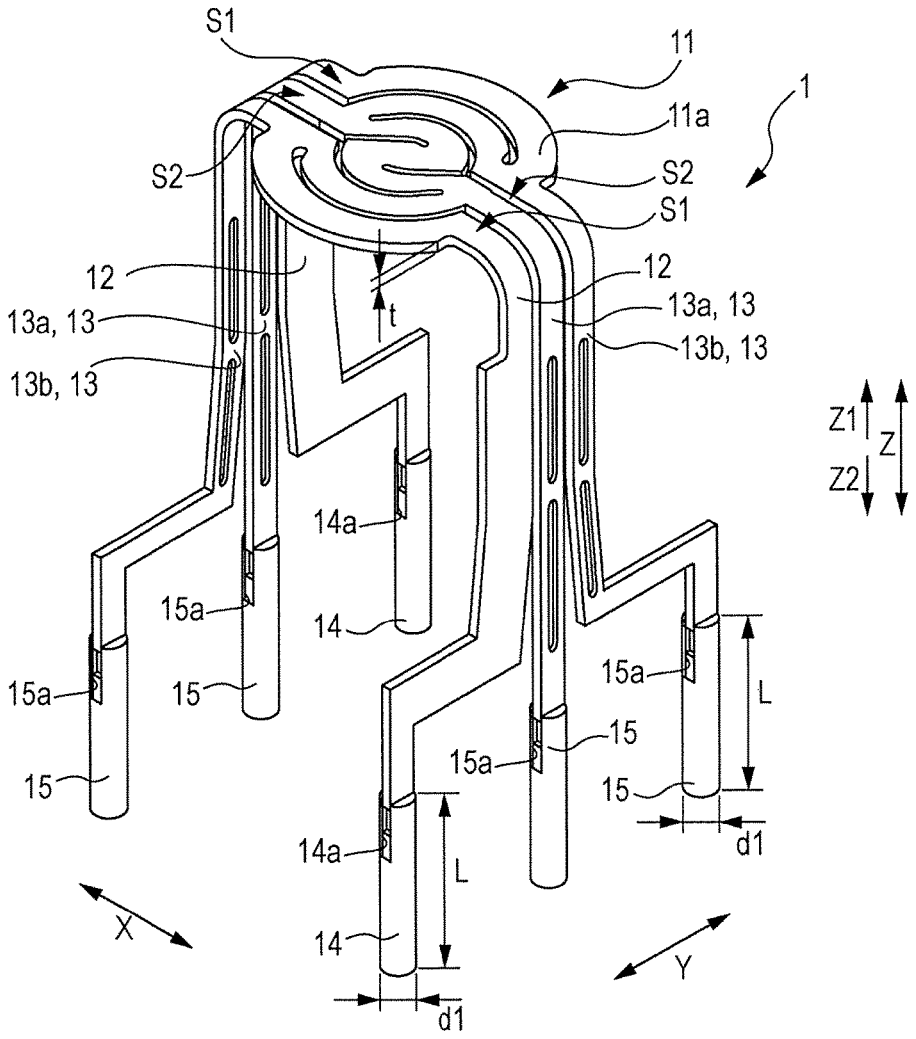
FIG. 2 is an exemplary perspective view of an emitter according to the first embodiment.

The emitter 1 will be described in detail. As shown in FIG. 2, the emitter 1 has a plate-shaped electron emission portion 11, current application legs 12, and support legs 13. The electron emission portion 11, the current application legs 12, and the support legs 13 may integrally be formed of the same member (i.e., one piece). The electron emission portion 11, the current application legs 12, and the support legs 13 can be formed of pure tungsten or tungsten alloy, for example. In the example of FIG. 2, the emitter 1 includes a pair of (two) current application legs 12 and two pairs of (four) support legs 13*a* and 13*b*.

The emitter 1 is a so-called thermionic emitter and is configured to be heated by the electric current through the pair of current application legs 12. Thus, the flat plate-shaped electron emission portion 11 is heated to reach a prescribed temperature (about 2400 K to about 2700 K) by a prescribed electric current so that the electron emission portion 11 emits electrons. The emitter 1 is covered with a metal cover (not shown). Hereinafter, for the sake of convenience, a direction orthogonal to an electron emission surface (upper surface) of the flat plate-shaped electron emission portion 11 will be referred to as a Z-direction (see FIG. 2). Two orthogonal directions within a plane parallel to the electron emission surface of the electron emission portion 11 are respectively an X-direction and a Y-direction (see, also, FIG. 2).

The emitter 1 includes current application leg fixing portions 14 for supporting respective ends of the current application legs 12, and supplying electric power to the current application legs 12. The emitter also includes support leg fixing portions 15 for supporting respective ends of the support legs 13. In the example of FIG. 2, the emitter 1 includes a pair of (two) current application leg fixing portions 14 corresponding to the current application legs 12 and two pairs of (four) support leg fixing portions 15 corresponding to the support legs 13.

The current application legs 12 are respectively fixed to the current application leg fixing portions 14. Similarly, the support legs 13 are fixed to the support leg fixing portions 15, respectively. The pair of current application leg fixing portions 14 are respectively connected to the wirings 5*a* and 5*b* (see FIG. 1). The support leg fixing portions 15 are not connected to any wirings and thus are in an electrically floating state. Accordingly, the support legs 13 and the support leg fixing portions 15 do not contribute to the application of the electric current to the emitter 1 to heat it and are kept maintained in a state where no electric current is substantially applied even when the emitter 1 is heated by the electric current.

Figure 3:
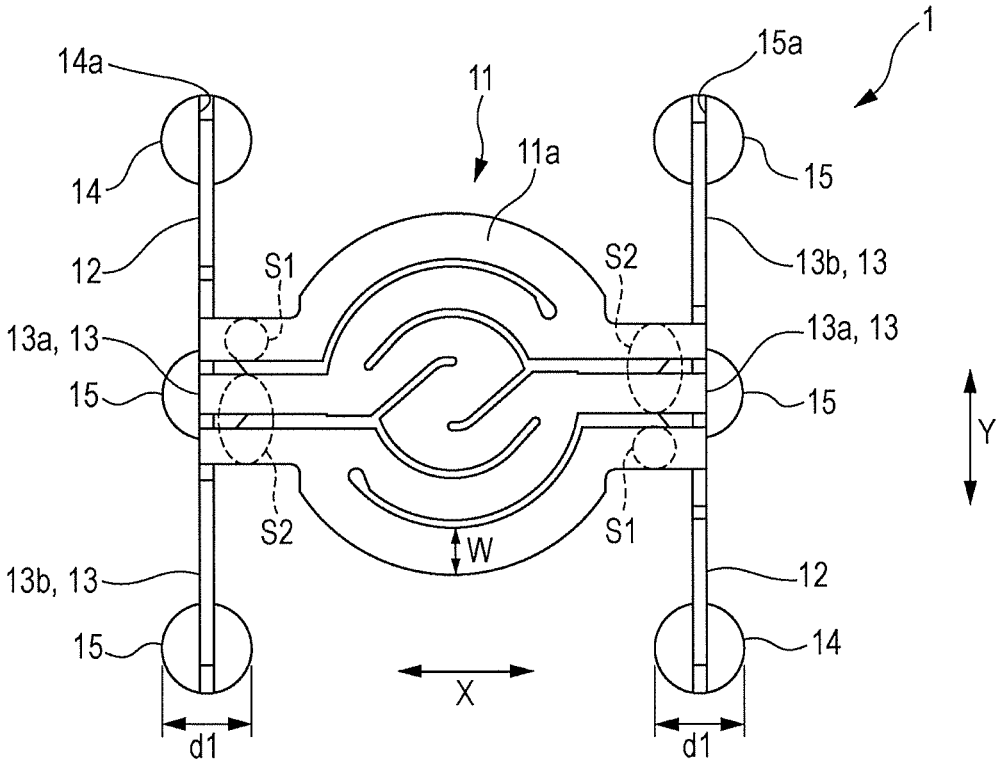
FIG. 3 is an exemplary plan view of an emitter according to the first embodiment.

As shown in FIGS. 2 and 3, the electron emission portion 11 is formed to have a flat plate shape by a winding (meandering) current path 11*a* and is formed to have a substantially circular shape in a plan view (when viewed from the Z-direction).

The current path 11*a* may have a substantially constant path width W (see FIG. 3) and have a flat plate shape having a substantially constant thickness t (see FIG. 2). The electron emission portion 11, the current application legs 12, and the support legs 13 have a common thickness t. The ends of the current path 11*a* are respectively connected to the respective current application legs 12. The current path 11*a* can be substantially point-symmetrically formed in a plan view.

The pair of current application legs 12 extends from the electron emission portion 11 and is formed by bending in a direction Z2 (see FIG. 2). The current application legs 12 are connected to respective ends of the current path 11*a*. The other ends of the pair of current application legs 12 are connected to the current application leg fixing portions 14, respectively. The current application legs 12 have shapes substantially equal to each other. The current application legs 12 each may have a bent plate shape.

The support legs 13 extend from the electron emission portion 11 and are formed by bending in the direction Z2 (see FIG. 2). The support legs 13 are provided separately from the current application leg 12, and support the electron emission portion 11. The support legs 13 are individually connected to the electron emission portion 11 (for example, connected to an intermediate portion of the electron emission portion 11 between the ends of the current path 11*a*). The other ends of the support legs 13 are respectively connected to the support leg fixing portions 15 in an electrically floating state. The support legs 13*a* may have shapes substantially equal to each other and each have a linear plate shape. The support legs 13*b* may also have shapes substantially equal to each other and each have a bent plate shape. The support legs 13*a* and 13*b* each have a through-hole penetrating in a plate thickness direction and formed to have a long hole shape in a longitudinal direction.

The current application leg fixing portions 14 and the support leg fixing portions 15 respectively include recesses 14*a* and 15*a*, and the current application legs 12 and the support legs 13 (13*a*, 13*b*) are inserted into the respective recesses 14*a* and 15*a* and joined thereto. Specifically, the recesses 14*a* and 15*a* are each formed to have a slit shape corresponding to the thickness t of the current application leg 12 and the support leg 13. The current application legs 12 and the support legs 13 are fixed respectively to the current application leg fixing portions 14 and the support leg fixing portions 15 by clamping work that presses the current application legs 12 and the support legs 13 so as to interpose the current application legs 12 and the support legs 13 from outer sides thereof and deforms them, in such a state that the current application legs 12 and the support legs 13 are inserted in the corresponding recesses 14*a* and 15*a*. The current application legs 12 and the support legs 13 may be fixed respectively to the current application leg fixing portions 14 and the support leg fixing portions 15 by another method such as welding.

The current application leg fixing portions 14 and the support leg fixing portions 15 each have a columnar shape extending in the Z-direction vertical to the electron emission portion 11 and are connected respectively to the current application legs 12 and the support legs 13 at their ends on the side in the direction Z1. The current application leg fixing portions 14 and the support leg fixing portions 15 are fixed to the container 3 at their ends on the side in the direction Z2.

At least one of materials and shapes can be different between the current application leg fixing portions 14 and the support leg fixing portions 15. With such a difference, a difference E1 (see FIG. 4) in the amount of thermal deformation between the current application legs 12 and the support legs 13 in the direction vertical to the electron emission portion 11 (Z-direction) can be reduced when the emitter 1 is heated by the electric current.

The first embodiment shows an example in which the materials of the current application leg fixing portions 14 and the support leg fixing portions 15 are different from each other. In the example of FIG. 2, the shapes of the current application leg fixing portions 14 and the support leg fixing portions 15 are substantially the same as each other. Specifically, the current application leg fixing portions 14 and the support leg fixing portions 15 have columnar shapes (bar shapes) having diameters d1 and lengths L substantially equal to each other and extending in the Z-direction.

The current application leg fixing portions 14 and the support leg fixing portions 15 are formed of, for example, a metal such as tungsten, rhenium, tantalum, osmium, molybdenum, nickel, niobium, iridium, boron, ruthenium, hafnium, alloys using these metals, or stainless steel. Accordingly, in the first embodiment, the current application leg fixing portions 14 and the support leg fixing portions 15 may be formed of different materials selected from those materials. The current application leg fixing portions 14 and the support leg fixing portions 15 may be formed of materials other than those metals. The current application leg fixing portions 14 may be formed of the same material as each other, and the support leg fixing portions 15 may also be formed of the same material as each other.

In the first embodiment, the current application leg fixing portions 14 and the support leg fixing portions 15 may be formed of materials having different coefficients of thermal expansion so that a difference in the amount of thermal deformation between the current application legs 12 and the support legs 13 can be reduced when the emitter 1 is heated with the electric current. Specifically, the support leg fixing portions 15 may be formed of a material having a coefficient of thermal expansion higher than that of the current application leg fixing portions 14. The current application leg fixing portions 14 are formed of a material having a first thermal expansion coefficient P1, and the support leg fixing portions 15 are formed of a material having a second thermal expansion coefficient P2. In the first embodiment, first thermal expansion coefficient P1 and second thermal expansion coefficient P2 may have the following relationship:

first thermal expansion coefficient P1<second thermal expansion coefficient P2.

Figure 4:
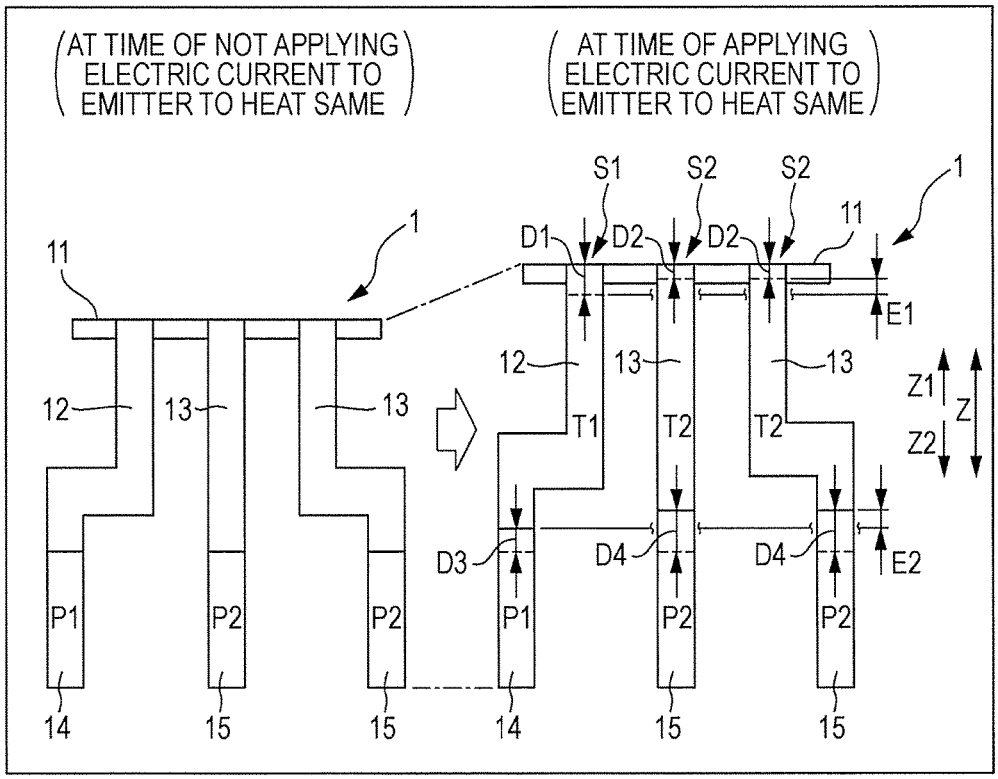
FIG. 4 is a schematic view for exemplarily explaining the amount of thermal deformation of each portion when an emitter is heated by an electric current.

The amount of thermal deformation in the emitter 1 at the time of applying the electric current to the emitter 1 to heat it will be described using the schematic diagram shown in FIG. 4. In the emitter 1, thermal deformation of each portion occurs due to an increase in temperature when the emitter 1 is heated by the electric current. The electron emission portion 11 is displaced in the Z-direction, as compared with a case where the emitter 1 is not heated by the electric current. In the emitter 1, thermal deformation in the X-direction and the Y-direction may naturally occurs, but for convenience of description, explanations will be given without regard for the thermal deformation in the X-direction and the Y-direction.

In this example, since the current application legs 12 and the support legs 13 are formed of the same material, their coefficients of thermal expansion are equal to each other. When the emitter 1 is heated by the electric current, since the electric current raises a temperature T1 of the current application legs 12 to become higher than a temperature T2 of the support legs 13, an amount D1 of the thermal deformation in the Z-direction of the current application legs 12 is greater than an amount D2 of the thermal deformation in the Z-direction of the support legs 13 (D1>D2). When the electron emission portion 11 is heated to about 2400 K to about 2700 K, a temperature difference of several hundred degrees may occur between the current application legs 12 and the support legs 13, for example.

Here, the amount of the thermal deformation in the Z-direction of the current application leg fixing portions 14 is taken to be D3, and the deformation of the thermal deformation amount in the Z-direction of the support leg fixing portions 15 is taken to be D4. Accordingly, a displacement amount of a connecting portion S1 (one end of the current application legs 12) between the electron emission portion 11 and the current application legs 12 corresponds to (D1+D3). A displacement amount of a connecting portion S2 (one end of the support legs 13) between the electron emission portion 11 and the support legs 13 due to heat at the time of applying the electric current to the emitter 1 corresponds to (D2+D4).

A magnitude relationship between a temperature of the current application leg fixing portions 14 and a temperature of the support leg fixing portions 15 is the same as a relationship between the temperature T1 of the current application legs 12 and the temperature T2 of the support legs 13 (T1>T2). Thus, for example, when the current application leg fixing portions 14 and the support leg fixing portions 15 are formed of the same materials (coefficients of thermal expansion) and have the same shapes, the displacement amount of the connecting portion S1 (D1+D3)>the displacement amount of the connecting portion S2 (D2+D4), so that the electron emission surface of the electron emission portion 11 is inclined and deformed.

To address this, in the first embodiment, the emitter 1 is configured such that when the material is selected to satisfy the relationship of the first thermal expansion coefficient P1<the second thermal expansion coefficient P2, the thermal deformation amount D4 in the Z-direction of the support leg fixing portions 15 is greater than the thermal deformation amount D3 in the Z-direction of the current application leg fixing portions 14 (D3<D4). In the first embodiment, the first thermal expansion coefficient P1 and the second thermal expansion coefficient P2 differ from each other so that the total of the thermal deformation amounts of the current application legs 12 and the current application leg fixing portions 14 (D1+D3) and the total of the thermal deformation amounts of the support legs 13 and the support leg fixing portions 15 (D2+D4) become closer to each other.

Consequently, the emitter 1 of the first embodiment is configured such that a difference E1 in thermal deformation amount between the current application legs 12 and the support legs 13 (equal to D1 minus D2) is cancelled by a difference E2 in thermal deformation amount between the current application leg fixing portion 14 and the support leg fixing portions 15 (equal to D3 minus D4), and the displacement amount of the electron emission surface of the electron emission portion 11 becomes substantially equal when the emitter 1 is heated by the electric current.

For selection of the materials of the current application leg fixing portions 14 and the support leg fixing portions 15 according to the difference in the amount of thermal deformation between the current application legs 12 and the support legs 13, their respective amounts of thermal deformation can be obtained by a computational method such as a simulation, and the first thermal expansion coefficient P1 and the second thermal expansion coefficient P2 reducing the difference in the amount of thermal deformation between the current application legs 12 and the support legs 13 are calculated. On that basis, the materials having a suitable coefficient of thermal expansion can be selected for the current application leg fixing portions 14 and the support leg fixing portions 15.

As an example, in the first embodiment, the current application leg fixing portions 14 are formed of molybdenum, and the first thermal expansion coefficient P1 is $4.9\times10^{-6}$ [/K]. The support leg fixing portions 15 are formed of nickel, and the second thermal expansion coefficient P2 is $13.3\times10^{-6}$ [/K]. A desirable coefficient of thermal expansion changes depending on the shapes and materials of the current application legs 12 and the support legs, 13 and the shapes and other parameters of the current application leg fixing portions 14 and the support leg fixing portions 15. A suitable material can be selected according to those parameters. For example, the coefficient of thermal expansion of tantalum is $6.3\times10^{-6}$ [/K], and the coefficient of thermal expansion of Type 304 stainless steel is $17.3\times10^{-6}$ [/K]. Thus, the current application leg fixing portions 14 may be formed of tantalum, and the support leg fixing portions 15 may be formed of Type 304 stainless steel.

Effects of First Embodiment

The first embodiment can provide the following effects.

The current application leg fixing portions 14 and the support leg fixing portions 15 may be formed of different materials to reduce the difference E1 in the amount of thermal deformation between the current application legs 12 and the support legs 13 in the direction vertical to the electron emission portion 11 (Z-direction) when the emitter 1 is heated by the electric current. Consequently, the amounts of the thermal deformation can be made differ between the current application leg fixing portions 14 and the support leg fixing portions 15. As a result, the difference E1 in the amount of thermal deformation between the current application legs 12 and the support legs 13 can be reduced due to the difference E2 in the amount of thermal deformation between the current application leg fixing portions 14 and the support leg fixing portions 15. It is thus possible to suppress deformation of the emission surface of the electron emission portion 11 caused by the difference in the amount of thermal deformation between the current application legs 12 and the support legs 13 when the emitter 1 is heated by the electric current.

The current application leg fixing portions 14 and the support leg fixing portions 15 are formed of materials having different coefficients of thermal expansion so that the difference E1 in the amount of thermal deformation between the current application legs 12 and the support legs 13 can be reduced when the emitter 1 is heated by the electric current. Consequently, the materials of the current application leg fixing portions 14 and the support leg fixing portions 15 are selected such that there is a suitable difference in the coefficient of thermal expansion between them. Thus, the difference E1 in the amount of thermal deformation between the current application legs 12 and the support legs 13 can be offset by the difference E2 in the amount of thermal deformation between the current application leg fixing portions 14 and the support leg fixing portions 15. The difference E1 can be effectively reduced.

The support leg fixing portions 15 are formed of a material having a coefficient of thermal expansion higher than that of the current application leg fixing portions 14. Since the temperature of the current application legs 12 becomes higher than the temperature of the support legs 13 by the application of the electric current, when the coefficient of thermal expansion of the support leg fixing portions 15 is set to be relatively high, the difference E1 in the amount of thermal deformation between the current application legs 12 and the support legs 13 can be reliably reduced.

The first thermal expansion coefficient P1 of the current application leg fixing portions 14 and the second thermal expansion coefficient P2 of the support leg fixing portions 15 differ from each other so that when the emitter 1 is heated by the electric current, the total of the amounts of thermal deformation of the current application legs 12 and the current application leg fixing portions 14 (D1+D3) and the total of the amounts of thermal deformation of the support legs 13 and the support leg fixing portions 15 (D2+D4) become closer to each other. Consequently, in consideration of the entire amount of thermal deformation of the current application legs 12 and the current application leg fixing portions 14 and the entire amount of thermal deformation of the support legs 13 and the support leg fixing portions 15, the first thermal expansion coefficient P1 and the second thermal expansion coefficient P2 can be set such that those amounts of thermal deformation become closer to each other. As a result, there are no cases in which the amount of thermal deformation of the support leg fixing portions 15 is too large, or the amount of thermal deformation of the current application leg fixing portions 14 is too small, and the difference E1 in the amount of thermal deformation between the current application legs 12 and the support legs 13 can be reliably and effectively reduced.

Furthermore, the current application leg fixing portions 14 and the support leg fixing portions 15 are each formed to have a columnar shape extending in the direction (Z-direction) vertical to the electron emission portion 11 and are connected respectively to the current application legs 12 and the support legs 13. Accordingly, since the amount of thermal deformation in the direction vertical to the electron emission portion 11 can be easily calculated, it is possible to easily obtain the materials and shapes of the current application leg fixing portions 14 and the support leg fixing portions 15 for reducing the difference E1 in the amount of thermal deformation between the current application legs 12 and the support legs 13.

Second Embodiment

Next, with reference to FIG. 5, an emitter 31 (in an X-ray tube device 101, see FIG. 1) according to a second embodiment of the present disclosure will be described. In the second embodiment, unlike the first embodiment in which the current application leg fixing portions 14 and the support leg fixing portions 15 are formed of different materials, current application leg fixing portions 34 and support leg fixing portions 35 have different shapes from each other. Elements identical to those of the first embodiment are denoted by like reference signs and explanations thereof will be omitted.

Figure 5:
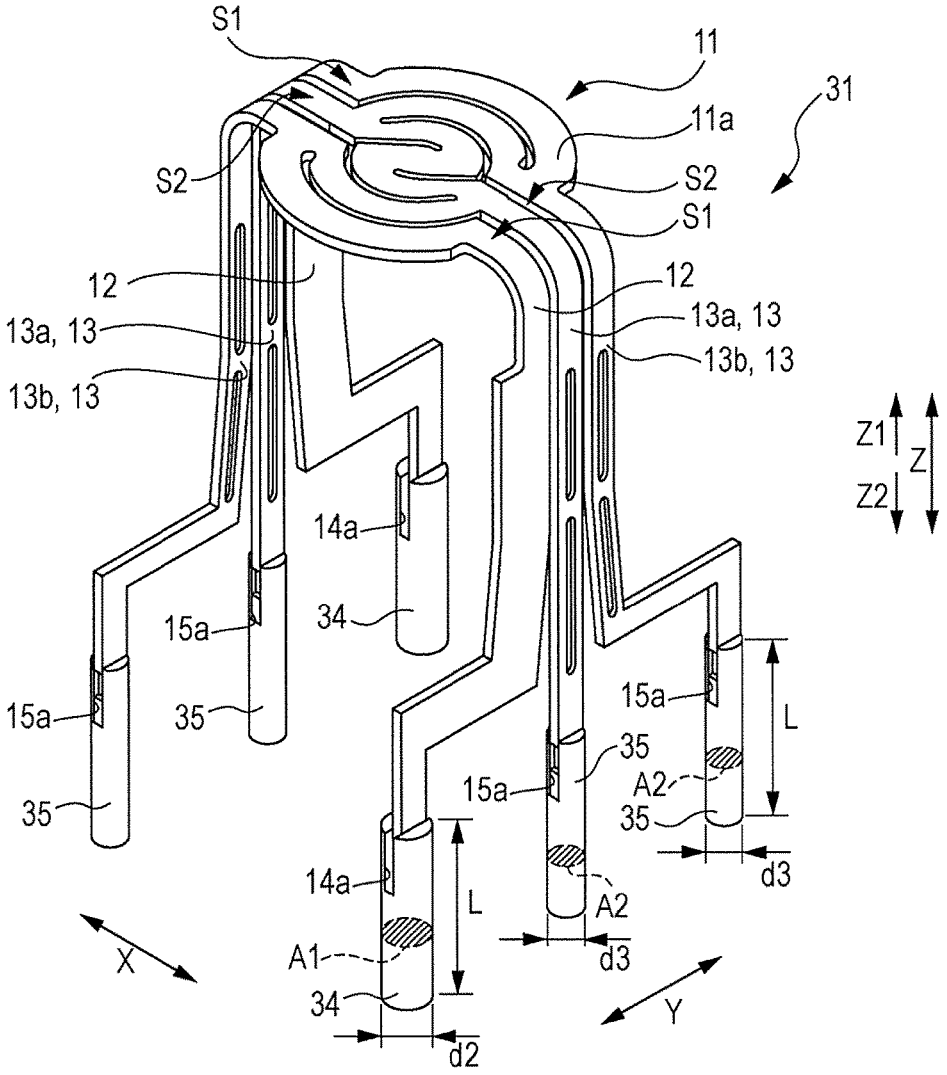
FIG. 5 is an exemplary perspective view of an emitter according to the second embodiment.

As shown in FIG. 5, in the emitter 31 according to the second embodiment, the current application leg fixing portions 34 and the support leg fixing portions 35 have different shapes from each other so that a difference E1 in the amount of thermal deformation between current application legs 12 and support legs 13 in the direction vertical to the electron emission portion 11 is reduced when the emitter 31 is heated by the electric current.

The current application leg fixing portions 34 and the support leg fixing portions 35 may be formed of the same material in this embodiment. The materials of the current application leg fixing portions 34 and the support leg fixing portions 35 can be selected from the materials described above, and the current application leg fixing portions 34 and the support leg fixing portions 35 may each be formed of, for example, molybdenum. Thus, there is a temperature difference between the current application leg fixing portions 34 and the support leg fixing portions 35 (see FIG. 4, between the current application legs 12 and the support legs 13) when the emitter 31 is heated by the electric current. A difference in the amount of thermal deformation corresponding to the temperature difference is produced.

Thus, in the second embodiment, the current application leg fixing portions 34 and the support leg fixing portions 35 have shapes having different cross-sectional areas in a direction parallel to the electron emission portion 11 so that a temperature difference between the current application legs 12 and the support legs 13 can be reduced when the emitter 31 is heated by an electric current. Specifically, the support leg fixing portions 35 each include a portion of which a cross-sectional area A2 in a direction parallel to the electron emission portion 11 (XY direction) is smaller than a cross-sectional area A1 of the current application leg fixing portions 34 in the direction parallel to the electron emission portion 11. Since locations where recesses 14*a* and 15*a* are formed are connecting portions to the current application legs 12 and the support legs 13, respectively, it is not necessary to consider those location.

The basic shapes of the current application leg fixing portions 34 and the support leg fixing portions 35 may be similar to those in the first embodiment. The current application leg fixing portions 34 and the support leg fixing portions 35 each have a columnar shape extending in the direction vertical to the electron emission portion 11, and are connected respectively to the current application legs 12 and the support legs 13 at their ends. Since FIG. 5 shows an example in which the current application leg fixing portions 34 and the support leg fixing portions 35 each have a cylindrical, columnar shape, the current application leg fixing portions 34 and the support leg fixing portions 35 have different diameters from each other and thereby have different cross-sectional areas.

Specifically, the current application leg fixing portions 34 each have a length L and a diameter d2, and the support leg fixing portions 35 each have the length L and a diameter d3. The diameter d2 of the current application leg fixing portions 34 is greater than the diameter d3 of the support leg fixing portions 35 (d2>d3). Accordingly, at the portions on the side in the direction Z2 relative to the location where the recesses 14*a* and 15*a* are formed, the cross-sectional area A2 of the support leg fixing portions 35 in the direction parallel to the electron emission portion 11 is smaller than the cross-sectional area A1 of the current application leg fixing portions 34 in the direction parallel to the electron emission portion 11. As a result, a heat transfer area (A2) of the support leg fixing portions 35 is smaller than a heat transfer area (A1) of the current application leg fixing portions 34.

Heat generated in the electron emission portion 11 by application of the electric current to the emitter 31 transfers to an end in the direction Z2 via the support leg fixing portions 35 and is released outside of the emitter 31, such as a container 3. Thus, when the heat transfer area A2 of the support leg fixing portions 35 is relatively reduced, the radiation performance of the support leg fixing portions 35 becomes relatively lower than the radiation performance of the current application leg fixing portions 34, so that the temperatures of the support legs 13 and the support leg fixing portions 35 are kept relatively high. Consequently, a temperature difference (T1−T2, see FIG. 4) between the current application legs 12 and the support legs 13 and a temperature difference between the current application leg fixing portions 34 and the support leg fixing portions 35 in the application of the electric current to the emitter 31 may be small, compared to a case where the current application leg fixing portions 34 and the support leg fixing portions 35 have the same shape as each other. As described above, the emitter 31 of the second embodiment is configured such that the difference E1 in the amount of thermal deformation between the current application legs 12 and the support legs 13 in the direction vertical to the electron emission portion 11 can by reduced by reducing the temperature difference (T1−T2) between the current application legs 12 and the support legs 13.

In the second embodiment, as an example, the diameter d2 of the current application leg fixing portions 34 is set to be 1.5 times as large as the diameter d3 of the support leg fixing portions 35.

Note that other configurations of the second embodiment are similar to those of the first embodiment.

Effects of Second Embodiment

The second embodiment can provide the following effects.

The current application leg fixing portions 34 and the support leg fixing portions 35 have different shapes from each other so that the difference E1 in the amount of thermal deformation between the current application legs 12 and the support legs 13 in the Z-direction vertical to the electron emission portion 11 can be reduced when the emitter 31 is heated by the electric current. Consequently, the temperature difference (T1−T2) between the current application legs 12 and the support legs 13 when the electric current is applied to the emitter 31 can be reduced by the difference in heat transfer amount between the current application leg fixing portions 34 and the support leg fixing portions 35. The difference E1 in the amount of thermal deformation between the current application legs 12 and the support legs 13 can thus be reduced. It may be possible to suppress deformation of the emission surface of the electron emission portion 11 caused by the difference in the amount of thermal deformation between the current application legs 12 and the support legs 13 when the emitter 31 is heated by the electric current.

The current application leg fixing portions 34 and the support leg fixing portions 35 have shapes respectively having different cross-sectional areas in the direction parallel to the electron emission portion 11 so that the temperature difference between the current application legs 12 and the support legs 13 can be reduced when the emitter 31 is heated by the electric current. Consequently, when the current application leg fixing portions 34 and the support leg fixing portions 35 have different heat transfer areas from each other, the temperature difference between the current application legs 12 and the support legs 13 can be reduced. The difference E1 in the amount of thermal deformation between the current application legs 12 and the support legs 13 can be reduced.

Further, the support leg fixing portions 35 includes the portion of which the cross-sectional area A2 in the direction parallel to the electron emission portion 11 is smaller than the cross-sectional area A1 of the current application leg fixing portions 34 in the direction parallel to the electron emission portion 11. Accordingly, since the temperature of the current application legs 12 becomes higher than the temperature of the support legs 13 by the electrical current, when the heat transfer area A2 of the support leg fixing portions 35 is made smaller than the heat transfer area A1 of the current application leg fixing portions 34, the temperature difference between the current application legs 12 and the support legs 13 can be reduced. As a result, the difference E1 in the amount of thermal deformation between the current application legs 12 and the support legs 13 can be reduced.

Third Embodiment

Figure 6:
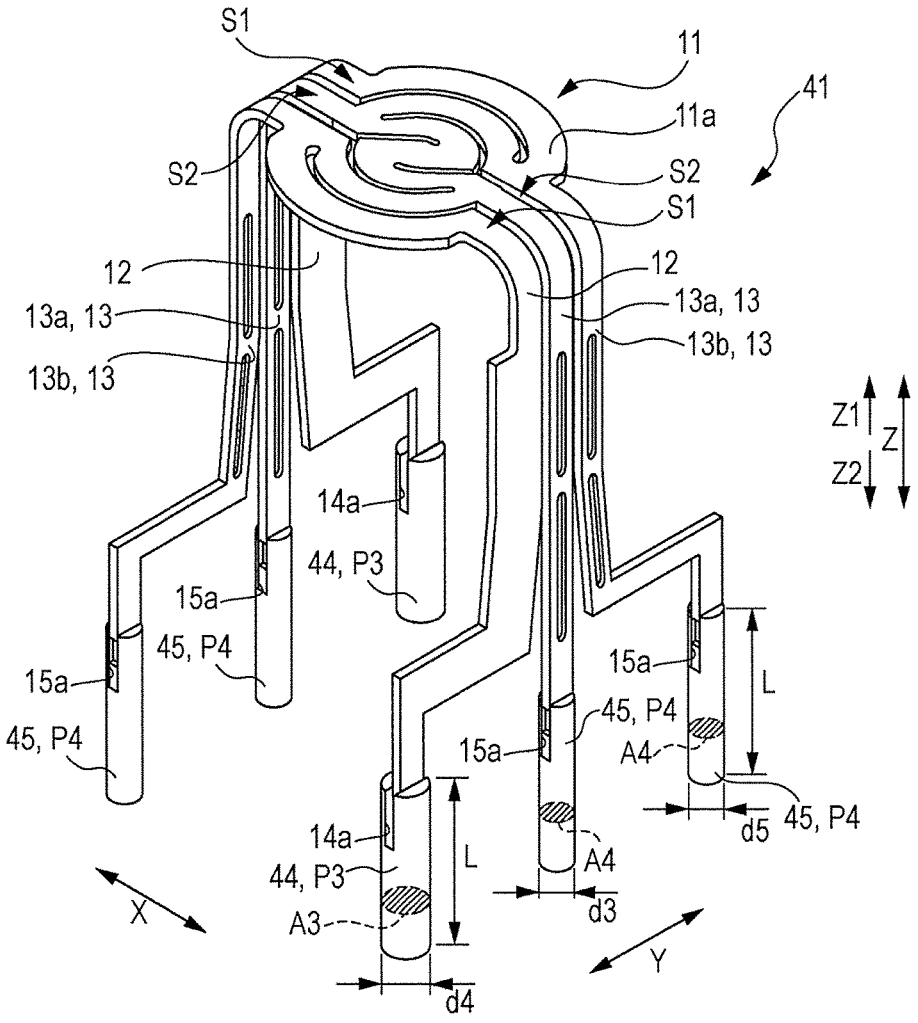
FIG. 6 is an exemplary perspective view of an emitter according to the third embodiment.

With reference to FIG. 6, an emitter 41 (in an X-ray tube device 102, see FIG. 1) according to a third embodiment of the present disclosure will be described. In the third embodiment, both materials and shapes of current application leg fixing portions 44 and support leg fixing portions 45 differ from each other. Elements identical to those of the first embodiment are denoted by like reference signs and explanations thereof will be omitted.

As shown in FIG. 6, in the emitter 41, both materials and shapes are different between the current application leg fixing portions 44 and the support leg fixing portions 45 so that a difference E1 in the amount of thermal deformation between current application legs 12 and support legs 13 in the direction vertical to an electron emission portion 11 can be reduced when the emitter 1 is heated by the electric current.

The materials of the current application leg fixing portions 44 and the support leg fixing portions 45 may be similar to those in the first embodiment. The current application leg fixing portions 44 and the support leg fixing portions 45 are formed of materials having different coefficients of thermal expansion so that the difference E1 (see FIG. 4) in the amount of thermal deformation between the current application legs 12 and the support legs 13 can be reduced when the emitter 1 is heated by the electric current. While the current application leg fixing portions 44 are formed of a material having a first thermal expansion coefficient P3, the support leg fixing portions 45 is formed of a material having a second thermal expansion coefficient P4, and these coefficients meet the following relationship: first thermal expansion coefficient P3<second thermal expansion coefficient P4.

The shapes of the current application leg fixing portions 44 and the support leg fixing portions 45 may be similar to those in the second embodiment. The current application leg fixing portions 44 and the support leg fixing portions 45 have shapes having different cross-sectional areas in the direction parallel to the electron emission portion 11 (XY direction) so that a temperature difference between the current application legs 12 and the support legs 13 can be reduced when the emitter 1 is heated by the electric current. A diameter d5 of the support leg fixing portions 45 is smaller than a diameter d4 of the current application leg fixing portions 44. In the support leg fixing portions 45, the cross-sectional area A4 in the direction parallel to the electron emission portion 11 is smaller than the cross-sectional area A3 of the current application leg fixing portions 44 in the direction parallel to the electron emission portion 11.

Other configurations of the third embodiment are similar to those of the first embodiment. In the third embodiment, effects similar to those of the first and second embodiments can be obtained.

(Explanation of Simulation Results)

Next, with reference to FIG. 7, results of simulation conducted for confirming the effects of the first and second embodiments will be explained.

Simulations were conducted for the emitter 1 according to the first embodiment (see FIG. 2), the emitter 31 according to the second embodiment (see FIG. 5), and an emitter according to a comparative example (not shown). Specifically, when each emitter is heated by the electric current, a displacement amount in the Z-direction at the connecting portion S1 between the current application legs and the electron emission portion and a displacement amount in the Z-direction at the connecting portion S2 between the support legs and the electron emission portions were calculated and compared. In the displacement amount, the direction Z1 was taken to be positive, and the displacement amount was an amount beginning from such a state that no electric current is applied to the emitter to heat it.

As shown in FIG. 7, in the emitter 1 according to the first embodiment, the current application leg fixing portions 14 were formed of molybdenum, and the support leg fixing portions 15 were formed of nickel. The shape of those portions has the length L and the diameter d1=1.24 mm.

In the emitter 31 according to the second embodiment, the current application leg fixing portions 34 and the support leg fixing portions 35 were each formed of molybdenum. The shape of the current application leg fixing portions 34 each have the length L and the diameter d2=1.5 mm. The shape of the support leg fixing portions 35 each have the length L and the diameter d3=1.0 mm.

In the emitter according to the comparative example, current application leg fixing portions and support leg fixing portions were formed of the same material and have the same shape. The material is molybdenum, and the shape has the length L and a diameter d=1.24 mm.

As shown in FIG. 7, in the emitter according to the comparative example, the displacement amount in the Z-direction at the connecting portion S1 between current application legs and electron emission portions was 88 μm, and the displacement amount in the Z-direction at the connecting portion S2 between support legs and the electron emission portions was 69 μm. A difference in displacement amount was 19 μm, which shows that the emission surface of the electron emission portion was deformed (tilted or distorted) by 19 μm, as compared with the state before the emitter was heated by the electric current.

In the emitter 1 according to the first embodiment, the displacement amount in the Z-direction at the connecting portion S1 between the current application legs 12 and the electron emission portions 11 was 92 μm, and the displacement amount in the Z-direction at the connecting portion S2 between the support legs 13 and the electron emission portions 11 was 100 μm. The difference in displacement amount was 8 μm, and it was confirmed that the difference in displacement amount could be suppressed and smaller than the comparative example.

In the emitter 31 according to the second embodiment, the displacement amount in the Z-direction at the connecting portion S1 between the current application legs 12 and the electron emission portions 11 was 86 μm, and the displacement amount in the Z-direction at the connecting portion S2 between the support legs 13 and the electron emission portions 11 was 69 μm. The difference in displacement amount was 17 μm, and it was confirmed that the difference in displacement amount could be suppressed and smaller than the comparative example.

From the above comparison, the effect of differentiating either the materials or the shapes of the current application leg fixing portions 14 and the support leg fixing portions 15 could be confirmed. In particular, in the emitter 1 according to the first embodiment, the displacement amount (100 μm) on the support legs 13 side that reach a relatively low temperature is more than the displacement amount (92 μm) on the current application legs 12 side, and it was found that the difference E1 in thermal deformation amount between the electrical conduction legs 12 and the support legs 13 could effectively be reduced by a difference between the first thermal expansion coefficient P1 and the second thermal expansion coefficient P2.

In the emitter 41 according to the third embodiment, it is clear from the above results that deformation of the emission surface can be suppressed comparable to or better than the first and second embodiments. When both the materials and the shapes of the current application leg fixing portions 14 and the support leg fixing portions 15 are optimized, the difference E1 in thermal deformation amount between the current application legs 12 and the support legs 13 can be further reduced.

(Variation)

It should be understood that the embodiments described above are in every aspect merely illustrative and not restrictive. The scope of the present disclosure is defined not by the description of the embodiment given above but by the appended claims, and encompasses any modifications or variations made in the spirit and scope equivalent to those of the claims.

Figure 8:
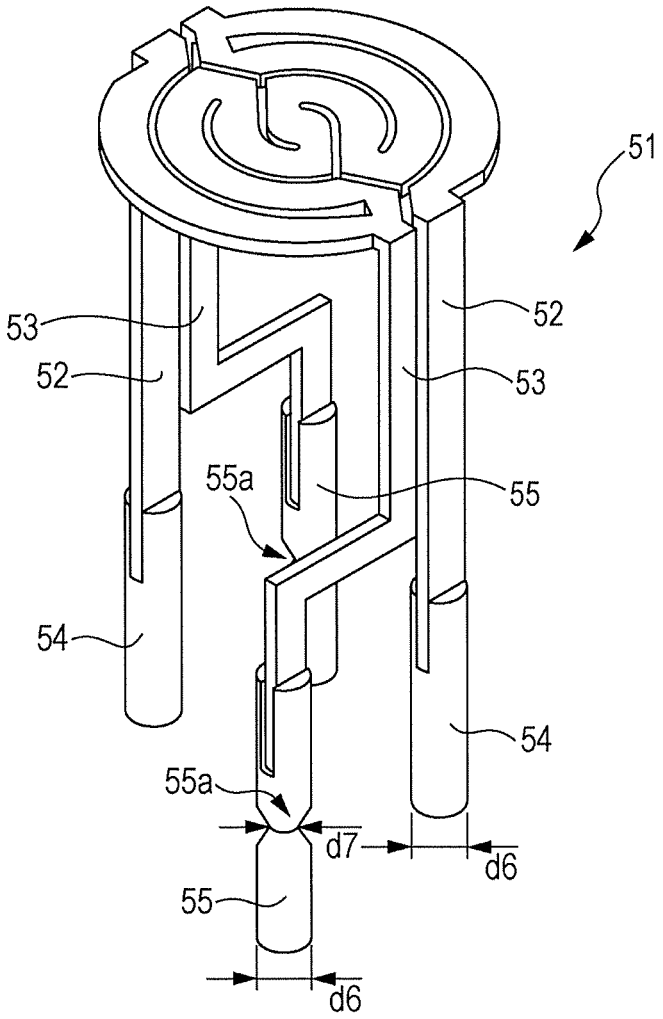
FIG. 8 is an exemplary perspective view of an emitter according to a variation of the second embodiment.

For example, although the first to third embodiments show the examples in which the emitter includes the two pairs of support legs, this disclosure is not limited to that example. For example, the emitter may include more than four support leg. As another example, an emitter 51 according to the variation shown in FIG. 8 includes a pair of current application legs 54 and a pair of support legs 55.

Further, although the first to third embodiments show the example in which the pair of current application leg fixing portions are formed of the same materials and have the same shapes, and the two pairs of support leg fixing portions are formed of the materials and have the same shapes, this disclosure is not limited to that example. In FIG. 2, for example, at least one of the materials and the shapes may be different between the support leg fixing portions 15 to which the support legs 13*a* are fixed respectively and the support leg fixing portions 15 to which the support legs 13*b* are fixed respectively. Its influence may be very small as compared with the difference E1 in thermal deformation amount between the current application legs 12 and the support legs 13. However, since the shape of the support legs 13*a* and the shape of the support legs 13*b* differ from each other, at least one of the materials and the shapes may be different between the support leg fixing portions 15. The same holds for the current application leg fixing portions.

Further, although the first to third embodiments show the example in which the current application leg fixing portions and the support leg fixing portions each have a columnar shape, this disclosure is not limited to that example. For example, the current application leg fixing portions and the support leg fixing portions may each have a shape other than the cylindrical columnar shape, such as a square columnar shape or a polygonal columnar shape. The current application leg fixing portions and the support leg fixing portions may have a cylindrical shape such as a circular cylindrical shape or a rectangular cylindrical shape. Alternatively, the current application leg fixing portion and the support leg fixing portion may have a bent shape or a curved shape.

Further, the second and third embodiments show the examples in which the columnar current application leg fixing portions and the support leg fixing portions differ from each other in diameter, whereby the heat transfer areas differ from each other. However, this disclosure is not limited to such an example. For example, as in the variation shown in FIG. 8, support leg fixing portions 55 having a diameter d6 equal to current application leg fixing portions 54 may include in its part a narrowing portion 55*a* having a smaller diameter. The narrowing portion 55*a* has a diameter d7 smaller than the diameter d6 of the current application leg fixing portions 54. Consequently, the heat transfer area (a cross-sectional area in the direction parallel to the electron emission portion) of the support leg fixing portions 55 is smaller than the heat transfer area of the current application leg fixing portions 54.

As other methods of reducing the heat transfer area, support leg fixing portions each may include a cutout or a through-hole or each may have a hollow shape such as a cylindrical shape.

In the above simulation, although there is shown an example in which the diameter d2 of the current application leg fixing portions 34 and the diameter d3 of the support leg fixing portions 35 in the emitter 31 according to the second embodiment are taken to be 1.5 mm and 1 mm, respectively. However, this disclosure is not limited to that example. The diameters d2 and d3 may be any value other than 1.5 mm and 1 mm. In practice, since the possible range of diameters is determined by a wide variety of factors such as mechanical strengths of the current application leg fixing portions 34 and the support leg fixing portions 35, an optimum value may be set within the range.

Further, in the second and third embodiments, as examples in which the current application leg fixing portions and the support leg fixing portions differ from each other in shape, the examples in which diameters of the cross-sectional area in the direction parallel to the electron emission portion differ are shown. However, this disclosure is not limited to those examples. As the shapes of the current application leg fixing portions and the support leg fixing portions, the lengths L in the Z-direction may differ from each other, for example. The longer the length L in the Z-direction is, the greater the thermal deformation amount in the Z-direction is. Therefore, when the lengths L in the Z-direction of the current application leg fixing portions and the support leg fixing portions differ from each other, the difference in thermal deformation amount between the current application legs and the support legs can be suppressed.

Furthermore, although the first to third embodiments show the examples in which the current application legs and the support legs each have a plate shape. This disclosure is not limited to that example. In this disclosure, the current application legs and the support legs may each have a shape other than the plate shape.

It is assumed for this example that the amount of thermal deformation of the support leg fixing portions is greater than that of the current application leg fixing portions because the support leg fixing portions are formed of a material having a coefficient of thermal expansion higher than that of the current application leg fixing portions. In the example, if the support leg fixing portions include a portion of which the cross-sectional area in the direction parallel to the electron emission portion is larger than the cross-sectional area in the direction parallel to the electron emission portion of the current application leg fixing portions, the difference in thermal deformation amount can be reduced.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. An emitter for an X-ray tube device, the emitter being configured to irradiate an anode with electrons for emitting an X-ray from the anode, the emitter comprising:

an electron emission portion to be heated by an electric current;

a current application leg for supplying the electric current to the electron emission portion, the current application leg extending from the electron emission portion in a direction vertical to the electron emission portion;

a support leg extending from the electron emission portion in the direction vertical to the electron emission portion;

a current application leg fixing portion for supporting the current application leg and supplying the electric current to the current application leg; and a support leg fixing portion for supporting the support leg, wherein at least one of materials and shapes are different between the current application leg fixing portion and the support leg fixing portion so that a difference in an amount of thermal deformation between the current application leg and the support leg in the direction vertical to the electron emission portion is reduced when the electron emission portion is heated by the electric current.

2. The emitter according to claim 1, wherein the support leg fixing portion is formed of a material having a coefficient of thermal expansion greater than that of the current application leg fixing portion.

3. The emitter according to claim 2, wherein the current application leg fixing portion is formed of a material having a first coefficient of thermal expansion, the support leg fixing portion is formed of a material having a second coefficient of thermal expansion, and the first coefficient of thermal expansion and the second coefficient of thermal expansion are different from each other so that when the electron emission portion is heated by the electric current, a total amount of the thermal deformation of the current application leg and the current application leg fixing portion and a total amount of the thermal deformation of the support leg and the support leg fixing portion become closer to each other.

4. The emitter according to claim 1, wherein the current application leg fixing portion and the support leg fixing portion respectively have shapes having different cross-sectional areas in a direction parallel to the electron emission portion so that a temperature difference between the current application leg and the support leg is reduced when the electron emission portion is heated by the electric current.

5. The emitter according to claim 4, wherein the support leg fixing portion comprises a portion of which a cross-sectional area in the direction parallel to the electron emission portion is smaller than a cross-sectional area of the current application leg fixing portion in the direction parallel to the electron emission portion.

6. The emitter according to claim 1, wherein the current application leg fixing portion and the support leg fixing portion each have a columnar shape extending in the direction vertical to the electron emission portion, and the current application leg fixing portion and the support leg fixing portion are connected to the current application leg and the support leg, respectively.

7. An X-ray tube device comprising:

an anode configured to emit an X-ray when the anode is irradiated with electrons;

an emitter configured to irradiate the anode with the electrons, the emitter comprising:

an electron emission portion to be heated by an electric current;

a current application leg for supplying the electric current to the electron emission portion, the current application leg extending from the electron emission portion in a direction vertical to the electron emission portion;

a support leg extending from the electron emission portion in the direction vertical to the electron emission portion;

a current application leg fixing portion for supporting the current application leg and supplying the electric current to the current application leg; and a support leg fixing portion for supporting the support leg, wherein at least one of materials and shapes are different between the current application leg fixing portion and the support leg fixing portion so that a difference in an amount of thermal deformation between the current application leg and the support leg in the direction vertical to the electron emission portion is reduced when the electron emission portion is heated by the electric current.

* * * * *